US010240785B2

(12) United States Patent
Konishi et al.

(10) Patent No.: US 10,240,785 B2
(45) Date of Patent: Mar. 26, 2019

(54) DRIVING METHOD FOR SOLENOID VALVE, SOLENOID VALVE DRIVING APPARATUS, AND COMBUSTION APPARATUS INCLUDING SAME

(75) Inventors: Daisuke Konishi, Hyogo (JP); Akira Ohta, Hyogo (JP); Yoshihisa Kitano, Hyogo (JP); Tomoya Nakano, Hyogo (JP); Yoshifumi Atobe, Hyogo (JP); Haruki Inoue, Hyogo (JP); Yoshitaka Kimura, Hyogo (JP); Ryo Ikeda, Hyogo (JP); Tomoki Kishimoto, Hyogo (JP); Yasuhide Ikeuchi, Hyogo (JP); Tomoko Ikeuchi, legal representative, Hyogo (JP)

(73) Assignee: Noritz Corporation (JP)

( * ) Notice: Subject to any disclaimer, the term of this patent is extended or adjusted under 35 U.S.C. 154(b) by 1276 days.

(21) Appl. No.: 12/929,469

(22) Filed: Jan. 27, 2011

(65) Prior Publication Data

US 2011/0183277 A1 Jul. 28, 2011

(30) Foreign Application Priority Data

Jan. 28, 2010 (JP) ..... 2010-016905
Jan. 28, 2010 (JP) ..... 2010-016906

(51) Int. Cl.

| | |
|---|---|
| ***F23N 1/00*** | (2006.01) |
| ***F23N 5/20*** | (2006.01) |
| ***F23K 5/14*** | (2006.01) |
| *H01H 47/32* | (2006.01) |

(52) U.S. Cl.

CPC ..... *F23K 5/147* (2013.01); *F23N 1/002* (2013.01); *F23N 5/203* (2013.01); *F23N 2035/14* (2013.01); *F23N 2035/16* (2013.01); *F23N 2037/02* (2013.01); *H01H 47/325* (2013.01)

(58) Field of Classification Search

USPC ..... 431/6, 18, 19, 24, 68, 253
See application file for complete search history.

(56) References Cited

U.S. PATENT DOCUMENTS

| | | | | | |
|---|---|---|---|---|---|
| 2,936,997 | A | * | 5/1960 | Nickells | 251/54 |
| 3,603,708 | A | * | 9/1971 | Good | 431/45 |
| 3,610,523 | A | * | 10/1971 | Troy | 237/8 R |
| 3,672,479 | A | * | 6/1972 | Schwertfeger et al. | 194/219 |

(Continued)

FOREIGN PATENT DOCUMENTS

| | | | | |
|---|---|---|---|---|
| JP | 58-065384 | A | 4/1983 | |
| JP | 2010107104 | A * | 5/2010 | F23N 5/24 |

*Primary Examiner* — Steven B McAllister
*Assistant Examiner* — Desmond C Peyton
(74) *Attorney, Agent, or Firm* — Fishman Stewart PLLC

(57) ABSTRACT

A solenoid valve driving apparatus includes switching means for ON/OFF-controlling application of a direct current voltage to a solenoid of a solenoid valve, and signal outputting means. A first period and a consecutive second period are set as a valve opening operation period of the solenoid valve. When the signal outputting means outputs the PWM signal to the switching means, a duty ratio of the output signal is set to be higher in the second period than in the first period so that a power supplied to the solenoid is larger in the second period than in the first period. As a result, a valve opening operation is performed in the solenoid valve reliably, and loud noise generation during the valve opening operation is suppressed.

5 Claims, 7 Drawing Sheets

(56) References Cited

U.S. PATENT DOCUMENTS

| | | | | | |
|---|---|---|---|---|---|
| 4,313,465 | A * | 2/1982 | Holzem | G05B 11/18 | 137/599.07 |
| 4,583,936 | A * | 4/1986 | Krieger | 431/1 | |
| 4,628,499 | A * | 12/1986 | Hammett | F15B 11/048 | 318/599 |
| 4,898,361 | A * | 2/1990 | Bender | F16H 61/0251 | 137/625.64 |
| 5,134,961 | A * | 8/1992 | Giles | A01M 7/0089 | 118/300 |
| 5,441,027 | A * | 8/1995 | Buchanon | F02M 57/02 | 123/446 |
| 6,056,000 | A * | 5/2000 | Santacatterina et al. | 137/1 | |
| 6,786,049 | B2 * | 9/2004 | Parsons et al. | 60/776 | |
| 7,735,743 | B2 * | 6/2010 | Jaeschke | 236/11 | |
| 8,123,517 | B2 * | 2/2012 | Peruch | 431/12 | |
| 2003/0217545 | A1 * | 11/2003 | Parsons et al. | 60/39.281 | |
| 2007/0003891 | A1 * | 1/2007 | Jaeschke | 431/19 | |
| 2008/0092826 | A1 * | 4/2008 | Kishimoto et al. | 122/14.1 | |
| 2009/0255245 | A1 * | 10/2009 | Wu | F15B 1/021 | 60/327 |
| 2009/0317755 | A1 * | 12/2009 | Kociecki | F23Q 7/24 | 431/66 |
| 2011/0183277 | A1 * | 7/2011 | Konishi et al. | 431/253 | |
| 2012/0000445 | A1 * | 1/2012 | Borg | F02D 41/3845 | 123/497 |

* cited by examiner

DRIVING METHOD FOR SOLENOID VALVE, SOLENOID VALVE DRIVING APPARATUS, AND COMBUSTION APPARATUS INCLUDING SAME

BACKGROUND OF THE INVENTION

1. Field of the Invention

The present invention relates to a method for driving a solenoid valve serving as a fluid control device favorably, a solenoid valve driving apparatus, and a combustion apparatus including the solenoid valve driving apparatus.

2. Description of the Related Art

A solenoid valve is used to switch a fuel supply in a combustion apparatus ON and OFF, for example. Japanese Patent Application Publication No. S58-65384 describes an example of an apparatus for driving this type of solenoid valve.

The apparatus described in this publication drives a solenoid valve using a PWM (Pulse Width Modulation) system, includes a switching element for switching application of a direct current voltage to a solenoid of the solenoid valve ON and OFF, and uses a PWM signal as a control signal for operating the switching element. When the solenoid valve is caused to perform a valve opening operation, a signal having a duty ratio of 100% is input into the switching element. After the solenoid valve has entered an open state, a PWM signal having a lower duty ratio than the signal used during the valve opening operation is input into the switching element as means for maintaining this state. According to this constitution, an amount of power supplied to the solenoid can be increased during the valve opening operation of the solenoid valve, and therefore the valve opening operation can be performed reliably. While maintaining the open state thereafter, the amount of power supplied to the solenoid can be suppressed, and therefore a reduction in energy consumption can be achieved.

With the conventional technique described above, however, the following problems may occur.

During the valve opening operation of the solenoid valve, a voltage is simply applied to the solenoid at a duty ratio of 100%, and therefore, although the solenoid can be supplied with a large amount of power, a comparatively loud noise may be generated as the valve opens. This noise is generated when a valve body of the solenoid valve and a plunger that supports the valve body are moved sharply by a large electromagnetic force from the solenoid such that a part of the plunger collides with a casing of the solenoid valve, for example. It is desirable to suppress this noise to the greatest extent possible.

As means for preventing this noise, the power supplied to the solenoid may be reduced so that the valve body does not move sharply. However, when this means is employed alone, it may be difficult to execute the valve opening operation appropriately. More specifically, for example, when a voltage of a direct current power supply connected to the solenoid valve becomes lower than a normal voltage for any reason, the power required for the valve opening operation may not be supplied to the solenoid valve, making it difficult to execute the valve opening operation appropriately. Further, when a combustion apparatus including the solenoid valve is driven to perform combustion for an extended period of time such that a temperature of the solenoid valve rises, an electric resistance of the solenoid increases, leading to a reduction in a current flowing to the solenoid. Hence, it may also be difficult to execute the valve opening operation when a combustion operation is resumed in the combustion apparatus after stopping the combustion apparatus following an extended combustion operation.

Furthermore, with the conventional technique described above, during a period in which the solenoid valve is maintained in the open state, a voltage is simply applied to the solenoid at a lower duty ratio than that of the valve opening operation such that the amount of power supplied to the solenoid is continuously suppressed. Hence, when a momentary power failure (for example, a power failure that is too short for an operation-controlling microcomputer to be reset) occurs such that the solenoid valve enters a closed state, the amount of power supplied to the solenoid following resumption of the power supply is small, and it may therefore be impossible to return the solenoid valve to the open state appropriately. The solenoid valve may be switched from the open state to the closed state unintentionally due to large pressure variation in a pipe passage to which the solenoid valve is attached, but with the conventional technique described above, it may likewise be impossible to return the solenoid valve to the open state in such a case. As a result, the solenoid valve remains in the closed state when it should be in the open state, and this situation is undesirable.

SUMMARY OF THE INVENTION

An object of the present invention is to provide a driving method for a solenoid valve, a solenoid valve driving apparatus, and a combustion apparatus including the solenoid valve driving apparatus with which the problems described above can be appropriately prevented or suppressed.

To achieve this object, the present invention teaches the following technical means.

A driving method for a solenoid valve according to a first aspect of the present invention includes a step of performing a valve opening operation in which a direct current voltage is applied to a solenoid of the solenoid valve in order to switch the solenoid valve from a closed state to an open state, wherein a first period and a consecutive second period are provided as a period of the valve opening operation, and control is performed to apply an intermittent voltage to the solenoid during the first period and apply a voltage having a higher duty ratio than the voltage of the first period during the second period, whereby a power supplied to the solenoid is larger in the second period than in the first period.

Preferably, the driving method for a solenoid valve according to the present invention further includes a step of supplying the power to the solenoid of the solenoid valve by applying the direct current voltage to the solenoid intermittently during a valve open state maintaining period occurring after the solenoid valve has been set in the open state, wherein a valve reopening period in which the power supplied to the solenoid is increased by temporarily increasing the duty ratio of the voltage applied to the solenoid at a predetermined timing is provided during the valve open state maintaining period so that when the solenoid valve enters the closed state, the solenoid valve can be caused to perform the valve opening operation again.

A solenoid valve driving apparatus according to a second aspect of the present invention includes: switching means for ON/OFF-controlling application of a direct current voltage to a solenoid of a solenoid valve; and signal outputting means capable of outputting a PWM signal as a control signal for operating the switching means, wherein a first period and a second period following the first period are set as a valve opening operation period for switching the solenoid valve from a closed state to an open state, and when the signal outputting means outputs the PWM signal to the switching means, a duty ratio of the output signal is set to be higher in the second period than in the first period so that a power supplied to the solenoid is larger in the second period than in the first period.

Preferably, the signal outputting means is capable of outputting a PWM signal for maintaining the open state after the valve opening operation period of the solenoid valve has elapsed, and a PWM signal of the first period has a duty ratio that is substantially identical to or higher than the PWM signal for maintaining the open state.

Preferably, a PWM signal of the second period has a duty ratio of 100%.

Preferably, a valve reopening period in which the power supplied to the solenoid is increased by temporarily increasing the duty ratio of the voltage applied to the solenoid at a predetermined timing so that when the solenoid valve enters the closed state, the solenoid valve can be caused to perform the valve opening operation again, is implemented while the signal outputting means outputs the PWM signal during a valve open state maintaining period occurring after the solenoid valve has been set in the open state.

Preferably, the predetermined timing at which the signal outputting means temporarily increases the duty ratio of the voltage applied to the solenoid arrives periodically at predetermined time intervals.

Preferably, the solenoid valve driving apparatus according to the present invention further includes detecting means for detecting a predetermined phenomenon that causes the solenoid valve to enter the closed state during the valve open state maintaining period, wherein the predetermined timing at which the signal outputting means temporarily increases the duty ratio of the voltage applied to the solenoid corresponds to a time at which the detecting means detects the predetermined phenomenon.

Preferably, the solenoid valve driving apparatus according to the present invention includes a plurality of solenoid valves, wherein, when the plurality of solenoid valves are in the valve open state maintaining period, implementation timings of the valve reopening period are set not to overlap.

Preferably, the solenoid valve driving apparatus according to the present invention includes a plurality of solenoid valves, wherein, when a part of the plurality of solenoid valves is in the valve open state maintaining period and an issued operation command indicates that a valve opening operation for switching another part of the solenoid valves from the closed state to the open state is to be performed at a timing that overlaps an implementation timing of the valve reopening period relating to the part of the solenoid valves, the valve opening operation corresponding to the operation command is prioritized such that the valve reopening period is implemented after the valve opening operation is completed.

A solenoid valve driving apparatus according to a third aspect of the present invention includes: switching means for ON/OFF-controlling application of a direct current voltage to a solenoid of a solenoid valve; and signal outputting means capable of outputting a PWM signal as a control signal for operating the switching means, wherein a valve reopening period in which a power supplied to the solenoid is increased by temporarily increasing a duty ratio of a voltage applied to the solenoid at a predetermined timing so that when the solenoid valve enters a closed state, the solenoid valve can be caused to perform a valve opening operation again, is implemented while the signal outputting means outputs the PWM signal during a valve open state maintaining period occurring after the solenoid valve has been set in an open state.

A combustion apparatus according to a fourth aspect of the present invention includes: a burner; a solenoid valve for switching a fuel supply to the burner ON and OFF; and a solenoid valve driving apparatus for opening and closing the solenoid valve, wherein the solenoid valve driving apparatus includes: switching means for ON/OFF-controlling application of a direct current voltage to a solenoid of the solenoid valve; and signal outputting means capable of outputting a PWM signal as a control signal for operating the switching means, a first period and a second period following the first period are set as a valve opening operation period for switching the solenoid valve from a closed state to an open state, and when the signal outputting means outputs the PWM signal to the switching means, a duty ratio of the output signal is set to be higher in the second period than in the first period so that a power supplied to the solenoid is larger in the second period than in the first period.

Further features and advantages of the present invention will become apparent from embodiments of the invention to be described below with reference to the attached drawings.

DESCRIPTION OF THE PREFERRED EMBODIMENTS

A specific preferred embodiment of the present invention will be described below with reference to the drawings.

Figure 1:
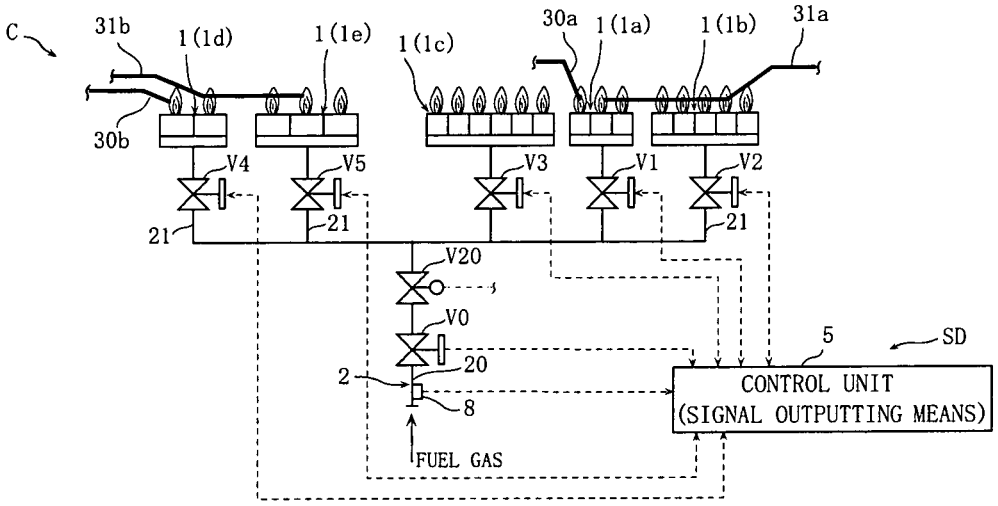
FIG. 1 is a schematic illustrative view showing an example of the constitution of a combustion apparatus according to the present invention.
Figure 2:
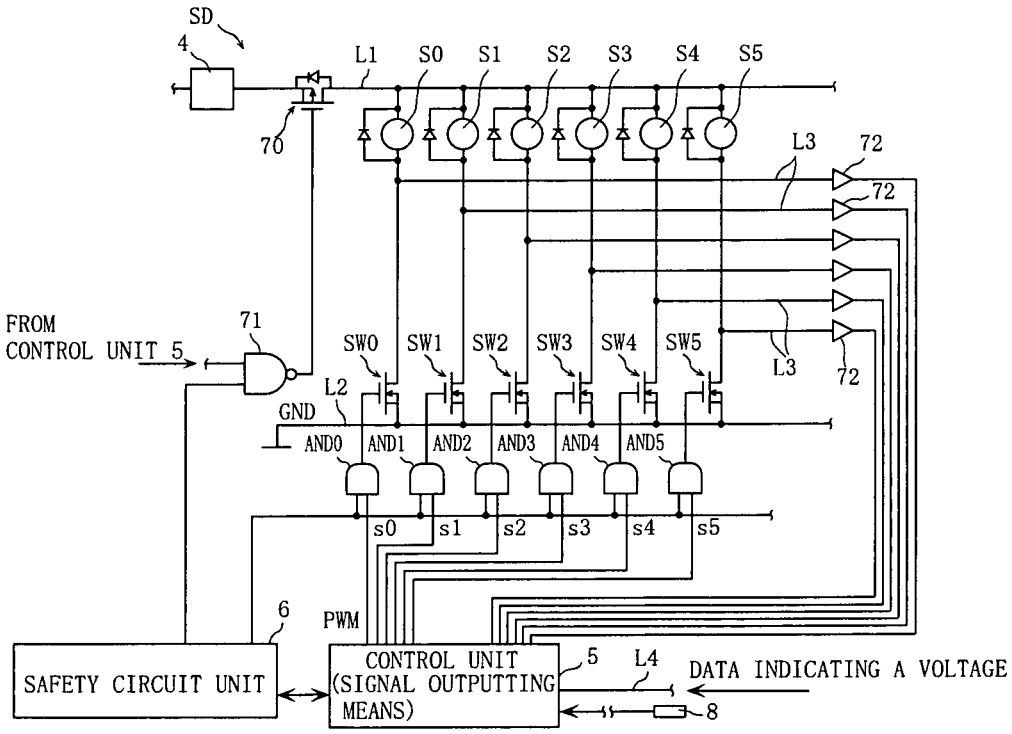
FIG. 2 is an illustrative view showing a solenoid valve driving apparatus provided in the combustion apparatus shown in FIG. 1.

FIGS. 1 and 2 show an example of a combustion apparatus including a solenoid valve driving apparatus to which the present invention is applied. As shown in FIG. 1, a combustion apparatus C according to this embodiment includes a plurality of gas burners 1 (1*a* to 1*e*), a fuel gas supply passage 2, a plurality of solenoid valves V0 to V5, a motorized valve V20, a pressure sensor 8, and a solenoid valve driving apparatus SD. The solenoid valve driving apparatus SD includes a control unit 5.

The combustion apparatus C is provided in a water heating apparatus (not shown) that supplies hot water for general use and hot water for bathing, for example, and is used to supply a fuel gas to a water-heating heat exchanger (not shown) of the water heating apparatus. Note, however, that the combustion apparatus according to the present invention is not limited to use in this application. The gas burners 1*a* to 1*c* are driven to perform combustion when the water heating apparatus supplies hot water for general use, while the gas burners 1*d*, 1*e* are driven to perform combustion when the water heating apparatus supplies hot water for bathing, for example. Spark plugs 30*a*, 30*b* and flame rods 31*a*, 31*b* for detecting a flame are provided above the gas burners 1*a* to 1*e*.

The fuel gas supply passage 2 includes a base pipe 20 for receiving a fuel gas supply from a gas pipe (not shown), and a plurality of branch pipes 21 that bifurcate from the base pipe 20 and are connected at one end to the gas burners 1*a* to 1*e*, respectively. The plurality of solenoid valves V0 to V5 are attached to the base pipe 20 and the plurality of branch pipes 21 as open/close valves. The solenoid valves V0 to V5 are all valves that close during a power failure and have a similar structure to that of a conventional solenoid valve. Hence, detailed description thereof has been omitted. The solenoid valves V0 to V5 respectively include solenoids S0 to S5 shown in FIG. 2, and by passing a current through the solenoids S0 to S5, the solenoid valves V0 to V5 can be caused to perform a valve opening operation individually.

The motorized valve V20 is attached to the base pipe 20 as a proportional valve capable of controlling a fuel gas flow rate continuously. Similarly to the solenoid valves V0 to V5, the motorized valve V20 is controlled by a control unit 5. Note, however, that control of the motorized valve is not an object of the present invention, and therefore description thereof has been omitted.

As shown in FIG. 2, the solenoid valve driving apparatus SD includes a direct current power supply circuit 4 (a direct current power supply) serving as a source of the power supplied to the plurality of solenoids S0 to S5, a plurality of switching elements SW0 to SW5 constituted by FETs, for example, and a safety circuit unit 6. The plurality of solenoids S0 to S5 and the plurality of switching elements SW0 to SW5 are connected to each other in series, and connected to each other in parallel between a connection wiring L1 and a ground wiring L2 of the direct current power supply circuit 4. Voltage application to (energization of) the plurality of solenoids S0 to S5 is controlled by switching the plurality of switching elements SW0 to SW5 ON and OFF.

The control unit 5 is constituted by a microcomputer capable of outputting PWM signals s0 to s5 as control signals for operating the switching elements SW0 to SW5. The control unit 5 corresponds to an example of signal outputting means according to the present invention. Note that the PWM signals are input into the switching elements SW0 to SW5 via AND circuits AND0 to AND5 for receiving signal input from the control unit 5 and the safety circuit unit 6. More specifically, the safety circuit unit 6 is capable of detecting a predetermined abnormality in the combustion apparatus C, and when the predetermined abnormality has not occurred in the combustion apparatus C, the safety circuit unit 6 outputs an "H" signal continuously to an input terminal of the AND circuits AND0 to AND5. Therefore, when the PWM signals s0 to s5 are input into another input terminal of the AND circuits AND0 to AND5 from the control unit 5, a PWM signal having an identical waveform is input into the switching elements SW0 to SW5 from the AND circuits ANDO to AND5. Hence, the switching elements SW0 to SW5 are switched ON and OFF in accordance with the PWM signal, whereby a direct current voltage is applied to the plurality of solenoids S0 to S5 intermittently.

When the predetermined abnormality occurs in the combustion apparatus C, the safety circuit unit 6 sets the signal input into the AND circuits AND0 to AND5 to "L". Accordingly, in this case, the switching elements SW0 to SW5 are all switched OFF such that energization of the solenoids S0 to S5 is stopped. As a result, the solenoid valves V0 to V5 enter a closed state such that the fuel gas supply to the gas burners 1 is interrupted. As other means for performing safety measures on the combustion apparatus C, a switching element 70 may be provided between the direct current power supply circuit 4 and the solenoids S0 to S5 such that when an abnormality occurs, the switching element 70 is set in an OFF state by switching the signal output from the safety circuit unit 6 and the control unit 5 to a NAND circuit 71. A voltage signal generated between the solenoids S0 to S5 and the switching elements SW0 to SW5 is input into the control unit 5 via a plurality of monitoring wiring units L3 provided respectively with buffer circuits 72. When a signal input via the monitoring wiring unit L3 does not correspond appropriately to the PWM signal output by the control unit 5, the control unit 5 determines that an abnormality has occurred.

A pressure sensor 8 corresponds to an example of detecting means according to the present invention, and detects pressure variation of at least a predetermined value in the fuel gas supply passage 2 on an upstream side of the solenoid valve V0 (a primary pressure side of the solenoid valve V0), for example. When a primary pressure of the solenoid valve V0 increases abnormally while the solenoid valve V0 is open, the solenoid valve V0 may close. The pressure sensor 8 is provided to detect this phenomenon. When a signal is input into the control unit 5 from the pressure sensor 8, the control unit 5 can determine that this phenomenon has occurred. Data indicating a voltage of the direct current power supply circuit unit 4 can be input into the control unit 5 via a wiring L4. Means for inputting the data indicating the voltage of the direct current power supply circuit unit 4 into the control unit 5 via the wiring L4 correspond to another example of the detecting means according to the present invention. When a momentary power failure occurs in the direct current power supply circuit unit 4 while the solenoid valves V0 to V5 are open, the solenoid valves V0 to V5 close. The control unit 5 is capable of determining whether or not a momentary power failure has occurred on the basis of the data indicating the voltage. The control unit 5 performs drive control on the solenoid valves V0 to V5 by outputting the PWM signals s0 to s5, and the specific content of this control will be described below.

Figure 5:
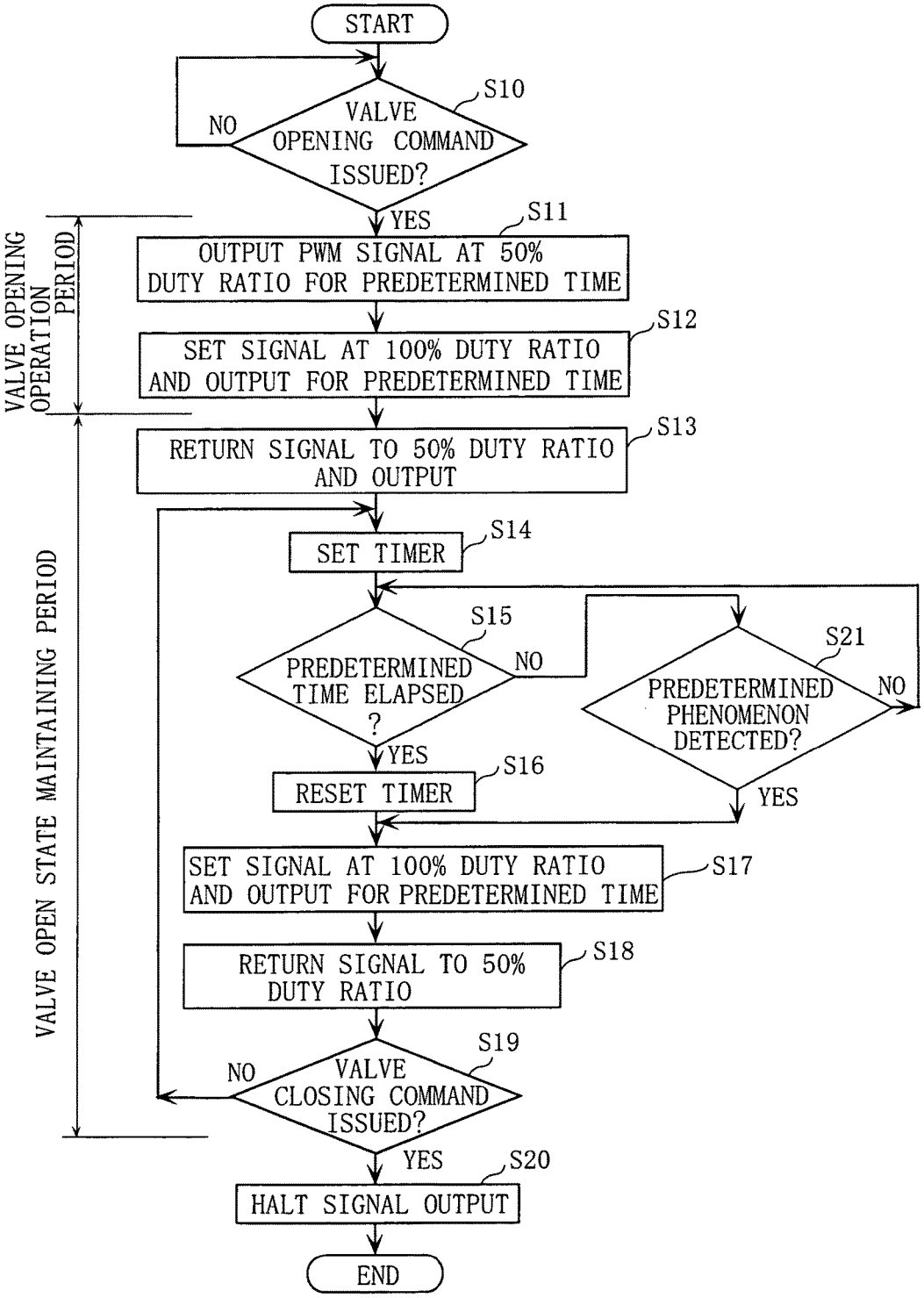
FIG. 5 is a flowchart showing an example of an operation control procedure executed by the control unit of the solenoid valve driving apparatus shown in FIG. 2.

Next, an example and an action of a solenoid valve driving method employed in the combustion apparatus C will be described with reference to a flowchart shown in FIG. 5. Note that in order to simplify the description, a case in which only one solenoid valve V0, from among the solenoid valves V0 to V5, is driven will be described as a representative example.

Figure 3:
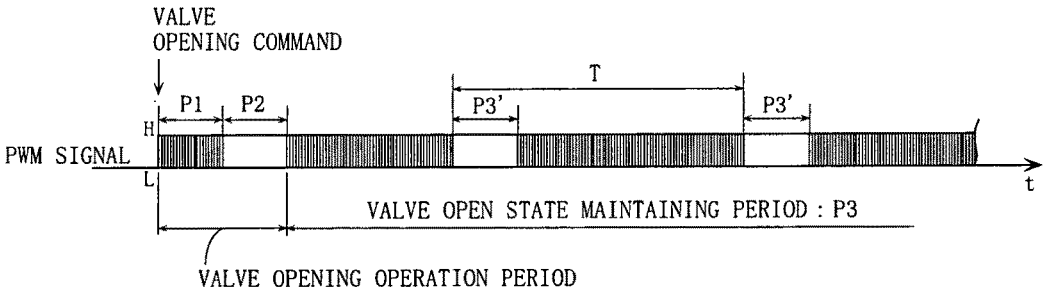
FIG. 3 is an illustrative view showing an example of a PWM signal output from a control unit of the solenoid valve driving apparatus shown in FIG. 2.

First, when the control unit 5 receives a valve opening command for driving the gas burner 1 to perform combustion (S10: YES), the control unit 5 outputs the PWM signal s0 to cause the solenoid valve V0 to execute the valve opening operation. As shown in FIG. 3, a first period P1 and a second period P2 are set as a valve opening operation period. Lengths of the first period P1 and the second period P2 are set respectively at 200 ms, for example. Note, however, that the present invention is not limited thereto.

During the first period P1, the control unit 5 outputs the PWM signal s0 at a duty ratio of 50%, for example (S11).

Although shown only schematically in FIG. 3, the PWM signal s0 is constituted by a plurality of intermittent pulse train waveforms. Accordingly, an ON/OFF operation corresponding to the PWM signal s0 is performed on the switching element SW0, and a voltage is applied intermittently to the solenoid S0 at the aforementioned duty ratio. During the second period P2, the control unit 5 outputs the signal at a duty ratio of 100% (S12). As a result, a voltage is applied to the solenoid S0 continuously throughout the entire second period P2. When voltage application is performed in this manner, a current flows to the solenoid S0 of the solenoid valve V0 in a manner shown in FIG. 4. Specifically, the current is larger in the second period P2 than in the first period P1. Accordingly, an amount of power supplied to the solenoid S0 is also larger in the second period P2 than in the first period P1.

By suppressing the power supplied to the solenoid S0 during the first period P1 to a comparatively small amount, an electromagnetic force generated by the solenoid S0 is reduced to a comparatively small amount. As a result, the solenoid valve V0 can be caused to perform the valve opening operation while preventing a valve body and a plunger (not shown) of the solenoid valve V0 from colliding sharply with a casing thereof (not shown). The power supplied to the solenoid S0 during the first period P1 is preferably set to be substantially equal to or slightly larger than a power supplied during a valve open state maintaining period P3 to be described below. With this constitution, a power that is substantially equal to or greater than a power required to keep the solenoid valve V0 open is supplied to the solenoid valve V0, and therefore the solenoid valve V0 is more likely to open during the first period P1.

As noted above, the amount of power supplied to the solenoid S0 during the first period P1 is suppressed. Hence, when the voltage applied to the solenoid S0 falls below a normal voltage or an electric resistance of the solenoid S0 rises due to a temperature increase, for example, as described above in the "Related Art" section, the electromagnetic force of the solenoid S0 weakens, and as a result, it may be impossible to execute the valve opening operation appropriately. During the second period P2, on the other hand, the power supplied to the solenoid S0 is increased, and therefore a comparatively strong electromagnetic force can be generated even when the applied voltage decreases, for example. As a result, the solenoid valve V0 can be caused to perform the valve opening operation appropriately. Hence, when the valve opening operation is performed in the second period P2 rather than in the first period P1, this may be taken to mean that a reduction has occurred in the applied voltage, for example. Accordingly, excessive power is not supplied to the solenoid valve V0 in the second period P2, and therefore the valve opening operation is performed while preventing the plunger of the solenoid valve V0 from colliding sharply with the casing. As a result, generation of a loud noise during the valve opening operation is suppressed appropriately in both the first and the second periods P1, P2.

In the valve open state maintaining period P3 following the second period P2, the control unit 5 returns the duty ratio of the PWM signal s0 to 50% (S13). As a result, the solenoid valve V0 is maintained in the open state while suppressing power consumption. After entering the valve open state maintaining period P3, the control unit 5 measures time using a timer, and when a predetermined time has elapsed, the control unit 5 resets the timer and sets the duty ratio of the PWM signal s0 at 100% for a predetermined amount of time (S14, S15: YES, S16, S17). The duty ratio of the PWM signal s0 is then returned to 50%, whereupon the processing described above is repeated until a valve closing command is received (S18, S19: NO). When the valve closing command is received, output of the PWM signal s0 is halted such that the solenoid valve V0 closes, and as a result, combustion-driving of the gas burner 1 is terminated (S19: YES, S20).

Figure 4:
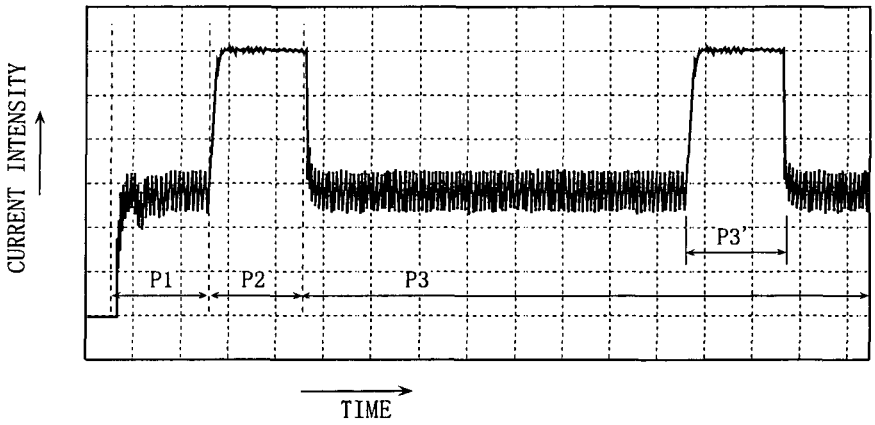
FIG. 4 is an illustrative view showing a waveform of a current that flows to a solenoid of a solenoid valve on the basis of the PWM signal shown in FIG. 3.

The period of the step S17 in which the signal is output at a duty ratio of 100% corresponds to a valve reopening period P3', a length of which is set at 200 ms, for example. As shown in FIG. 3, the valve reopening period P3' is provided repeatedly at intervals of a predetermined period T (a period of 2.4 s, for example). Further, as shown in FIG. 4, the current flowing to the solenoid S0 is increased during the valve reopening period P3', similarly to the second period P2. By providing the valve reopening period P3' repeatedly at intervals of the predetermined period T, a large amount of power is supplied to the solenoid S0 when the valve reopening period P3' arrives, and therefore, if the solenoid valve V0 has closed for some reason, the solenoid valve V0 can be returned to the open state. On the other hand, the valve reopening period P3' appears only temporarily. During the periods in the valve open state maintaining period P3 other than the valve reopening period P3', a voltage is applied to the solenoid S0 at a low duty ratio. Therefore, a large increase in power consumption does not occur.

When the control unit 5 detects a predetermined phenomenon during the valve open state maintaining period P3, the valve reopening period P3' is implemented such that the PWM signal s0 is set at a duty ratio of 100% for a predetermined amount of time (S21: YES, S17). Here, the predetermined phenomenon is a momentary power failure in the direct current power supply circuit unit 4 or an abnormal increase in the primary pressure of the solenoid valve V0. As described above, these phenomena cause the solenoid valve V0 to close and are therefore detected by the control unit 5. When the predetermined phenomenon occurs, the valve reopening period P3' is implemented as soon as the control unit 5 detects the predetermined phenomenon, and therefore an operation for returning the closed solenoid valve V0 to the open state is performed quickly. When the solenoid valve V0 closes for a reason other than a momentary power failure or an abnormal increase in the primary pressure of the solenoid valve V0, the solenoid valve V0 is returned to the open state during the valve reopening period P3' set at the predetermined period.

When the solenoid valve V0 temporarily enters the closed state, combustion-driving of the gas burner 1 may be stopped. However, this combustion-driving stoppage is detected using the flame rods 31*a*, 31*b*, and an ignition operation is executed favorably upon detection. The solenoid valve V0 was described above as a representative example, but the other solenoid valves V1 to V5 are driven appropriately in a similar manner to that described above.

When all or any plurality of the solenoid valves V0 to V5 enter the valve open state maintaining period P3, the control unit 5 performs operation control to be described below.

Figure 6:
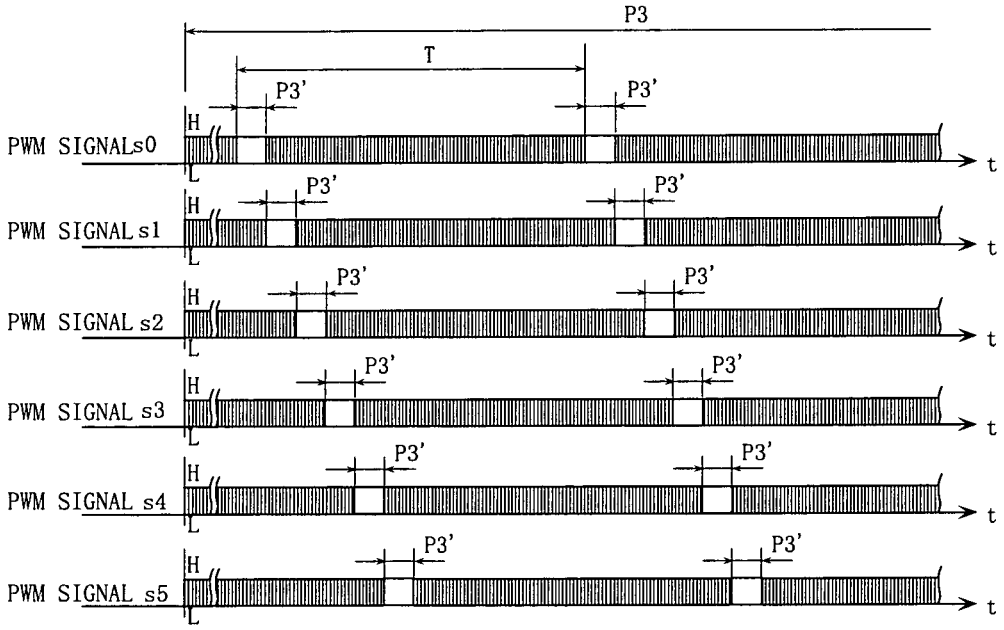
FIG. 6 is an illustrative view showing an example of a case in which a plurality of PWM signals are output from the control unit of the solenoid valve driving apparatus shown in FIG. 2.

As shown in FIG. 6, during the valve open state maintaining period P3, the control unit 5 basically outputs the PWM signals s0 to s5 at a duty ratio of 50%, for example. In addition, the control unit 5 sets the valve reopening period P3' to occur at the fixed period T and whenever the predetermined phenomena (the phenomena described above in relation to the step S21) occur. Note, however, that control is performed to stagger timings of the valve reopening period P3' relating to the respective PWM signals s0 to s5 so that the periods do not overlap.

According to this control, large amounts of power are not supplied simultaneously to the respective solenoid valves V0 to V5 from the direct current power supply circuit unit 4. Hence, a capacity of the direct current power supply circuit unit 4 can be favorably reduced. Further, when all of the solenoid valves V0 to V5 enter the closed state, operations for returning the solenoid valves V0 to V5 to the open state are not performed simultaneously, and instead return operation timings are staggered. When all of the solenoid valves V0 to V5 are returned to the open state at once, fuel gas supply is resumed to all of the gas burners 1*a* to 1*e* simultaneously, and if an ignition operation is performed in this state, so-called explosion ignition, or ignition in a state close to explosion ignition, occurs. By executing this control, however, an effect of preventing this situation appropriately is obtained.

When the central gas burner 1*a*, from among the gas burners 1*a* to 1*c* shown in FIG. 1, is subjected to combustion-driving first, flame transfer to the gas burners 1*b*, 1*c* occurs thereafter. As a result, all of the gas burners 1*a* to 1*c* can be driven to perform combustion appropriately. Likewise, when the gas burner 1*d* is driven to perform combustion before the gas burner 1*e*, flame transfer to the gas burner 1*e* occurs thereafter, and as a result, the gas burners 1*d*, 1*e* can be driven to perform combustion appropriately.

In the constitution shown in FIG. 1, the single flame rod 31*a* is used for three gas burners 1*a* to 1*c*, for example. Moreover, the flame rod 31*a* is shared by two gas burners 1*a*, 1*b*. With this constitution, the total number of flame rods can be reduced, enabling a reduction in manufacturing cost. Further, the following effect is obtained. When the solenoid valves V1, V3, for example, close during combustion-driving of the gas burners 1*a* to 1*c* such that the gas burners 1*a*, 1*c* misfire, the flame rod 31*a* continues to detect a flame as long as combustion-driving of the gas burner 1*b* continues. In this case, the control unit 5 is unable to detect the misfire condition of the gas burners 1*a*, 1*c* and therefore determines that combustion-driving is underway in the gas burners 1*a* to 1*c*. However, when the solenoid valve V1 is returned to the open state using the control according to the present invention, flame transfer occurs from the gas burner 1*b* to the gas burner 1*a*, and therefore the gas burner 1*a* can be driven to perform combustion appropriately. Further, when the solenoid valve V3 is thereafter returned to the open state, flame transfer occurs from the gas burner 1*a* to the gas burner 1*c*, and therefore the gas burner 1*c* can be driven to perform combustion. Hence, by returning the solenoid valves V1, V3 to the open state, all of the gas burners 1*a* to 1*c* can be driven appropriately.

Figure 7:
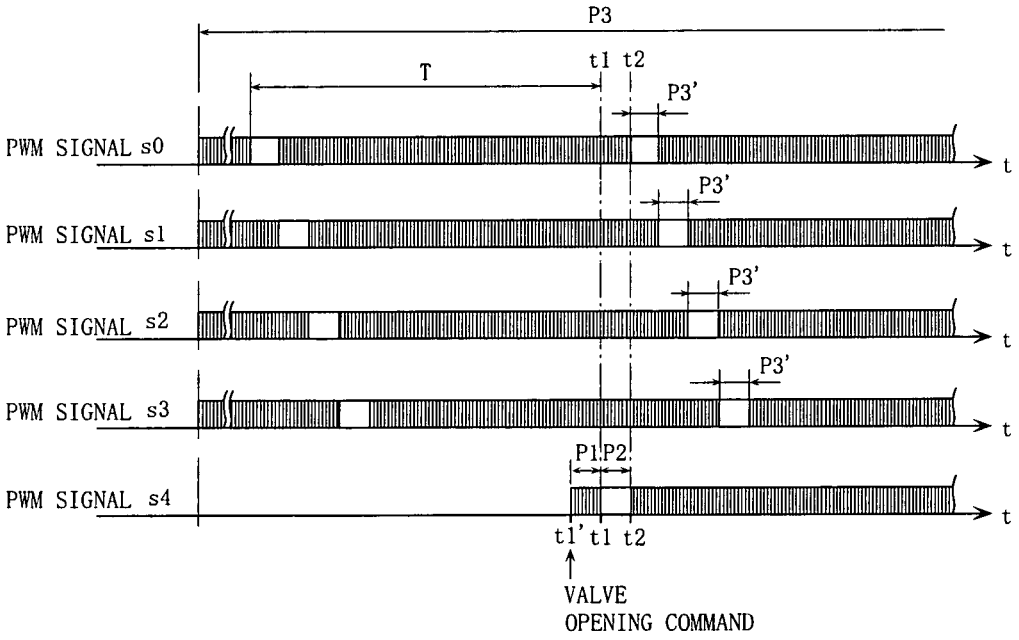
FIG. 7 is an illustrative view showing another example of a case in which a plurality of PWM signals are output from the control unit of the solenoid valve driving apparatus shown in FIG. 2.

FIG. 7 shows an example of the manner in which the PWM signals s0 to s4 are output in a case where the solenoid valves V0 to V3 are open, the solenoid valve V4 is closed, and a valve opening command relating to the solenoid valve V4 is received. FIG. 7 shows a case in which the valve reopening period P3' is set to occur at a predetermined time t1 with respect to the PWM signal s0 and the valve opening command for the solenoid valve V4 is received at a time t1' that is substantially simultaneous with the time t1. In this case, the control unit 5 prioritizes the valve opening operation of the solenoid valve V4, and therefore sets the first period P1 and the second period P2 as the valve opening operation period and outputs the PWM signal s4. The valve reopening period P3' relating to the PWM signal s0, meanwhile, is started at a time t2 following the end of the second period P2. Set timings of the valve reopening periods P3' relating to the other PWM signals s1 to s3 are likewise staggered successively in accordance with the PWM signal s0. Although not shown in FIG. 7, in a case where a valve opening operation is started in the solenoid valve V5 following the valve opening operation of the solenoid valve V4, the set timings of the valve reopening periods P3' relating to the PWM signals s0 to s3 are staggered successively in order to avoid the valve opening operation timing of the solenoid valve V5.

By executing the control described above, large amounts of power are not supplied simultaneously to the respective solenoid valves V0 to V5 from the direct current power supply circuit unit 4, and therefore the capacity of the direct current power supply circuit unit 4 can be favorably reduced. Further, by prioritizing the valve opening operations of the solenoid valves V4, V5 over the valve reopening periods P3' of the solenoid valves V0 to V3, a situation in which insufficient power is supplied to the solenoid valves V4, V5 can be avoided, and therefore the valve opening operations of the solenoid valves V4, V5 can be performed more reliably.

The present invention is not limited to the content of the embodiment described above, and specific constitutions of the driving method for a solenoid valve according to the present invention may be modified freely within the intended scope of the present invention. Further, specific constitutions of respective parts of the solenoid valve driving apparatus and combustion apparatus according to the present invention may be subjected to various design modifications.

In the second period of the valve opening operation period according to the present invention, it is sufficient for a voltage having a higher duty ratio than that of the first period to be applied to the solenoid of the solenoid valve. Hence, the duty ratio of the voltage applied during the second period may be set at a value of less than 100%. The PWM signal for operating the switching means does not necessarily have to be output from a control unit employing a microcomputer, and for example, a dedicated circuit for generating a PWM signal may be provided such that the PWM signal is output to the switching means from this circuit.

Specific duty ratio values of the PWM signal during the valve open state maintaining period according to the present invention are not limited to the aforesaid values (50% and 100%) as long as the duty ratio of the valve reopening period is set to be higher than the normal duty ratio of the valve open state maintaining period (the period excluding the valve reopening period).

In addition to the momentary power failure and the abnormal increase in the primary pressure of the solenoid valve noted in the above embodiment, an impact occurring when a mechanical load acts directly on the solenoid valve, for example, may be cited as another factor causing the solenoid valve to close during the valve open state maintaining period. Hence, a constitution in which the valve reopening period is implemented upon detection of this type of impact may be employed, and specific content relating to this factor may be selected appropriately. Furthermore, a constitution in which detecting means for detecting a predetermined factor is not provided and instead the valve reopening period is implemented when control means performs output for driving a predetermined device (a device that may generate a load for closing the solenoid valve, for example) may be employed in place of the constitution described above.

The solenoid valve to which the present invention is applied is not limited to a solenoid valve provided in a combustion apparatus, and the present invention may be applied to a solenoid valve provided in various types of apparatuses and devices other than a combustion apparatus. For example, the present invention may be applied to a solenoid valve provided in a hot water pipe passage of a water heating apparatus for supplying hot water, for underfloor heating, and so on, for example. Further, the combustion apparatus according to the present invention may be used for various applications (a gas fan heater, a gas stove burner, and so on, fora example), rather than as a constitutional element of a water heating apparatus such as a hot water supply apparatus. Moreover, the combustion apparatus may use a substance other than gas (fuel oil or the like, for example) as a fuel.

What is claimed is:

1. A solenoid valve driving apparatus for driving a plurality of solenoid valves that respectively control a plurality of burners, the solenoid valve driving apparatus comprising:

switching means for ON/OFF-controlling application of a direct current voltage to a plurality of solenoids of the plurality of solenoid valves;

signal outputting means capable of outputting a plurality of PWM signals corresponding to the plurality of solenoids as a control signal for operating the switching means, wherein the signal outputting means outputs the PWM signals with predetermined first duty ratios during a valve open state maintaining period that occurs after each solenoid valve has been set in an open state, the signal outputting means measures time using a timer and temporarily changes a first duty ratio of each of the PWM signals to a second duty ratio higher than the first duty ratio after a predetermined time has elapsed, a period of the second duty ratio being a valve reopening period in which a power supplied to the solenoid is increased, and the solenoid valve can be caused to perform a valve opening operation again when each solenoid valve enters a closed state, the valve reopening period being periodically implemented such that the first duty ratio is periodically changed to the second duty ratio respectively in each of the plurality of PWM signals corresponding to the plurality of solenoids during the valve open state maintaining period, and wherein, when a part of the plurality of solenoid valves is in the valve open state maintaining period and an issued operation command indicates that one or more additional valve opening operations for switching other solenoid valves from the closed state to the open state is to be performed at a timing that overlaps an implementation timing of the valve reopening period relating to the part of the solenoid valves, each of the one or more additional valve opening operations corresponding to the operation command is prioritized such that the valve reopening period is implemented after each of the one or more additional valve opening operations is completed; and a detecting means for detecting a predetermined phenomenon that causes each solenoid valve to enter the closed state during the valve open state maintaining period, wherein the signal outputting means temporarily increases the first duty ratio of the voltage applied to the solenoid to open the solenoid when the detecting means detects the predetermined phenomenon.

2. The solenoid valve driving apparatus according to claim 1, wherein, when the plurality of solenoid valves are in the valve open state maintaining period, implementation timings of the valve reopening period are set not to overlap.

3. The solenoid valve driving apparatus according to claim 1, wherein a first period and a second period following the first period are set as a valve opening operation period for switching each solenoid valve from a closed state to an open state, and wherein, when the signal outputting means outputs the PWM signal to the switching means, the output signal is set to the second duty ratio in the second period so that a power supplied to the solenoid is larger in the second period than in the first period.

4. A combustion apparatus comprising:

a burner;

a plurality of solenoid valves for switching a fuel supply to the burner ON and OFF; and the solenoid valve driving apparatus according to claim 1 for opening and closing the plurality of solenoid valves.

5. A solenoid valve driving apparatus for driving a plurality of solenoid valves, the solenoid valve driving apparatus comprising:

a plurality of switching elements respectively configured to ON/OFF-control application of a direct current voltage to a plurality of solenoids of the plurality of solenoid valves, wherein the plurality of solenoid valves respectively control a plurality of burners; and a control unit configured to output a plurality of PWM signals corresponding to the plurality of solenoid valves as a control signal for operating the plurality of switching elements, wherein the control unit outputs the PWM signals with predetermined first duty ratios during a valve open state maintaining period that occurs after each solenoid valve has been set in an open state, the control unit measures time using a timer and temporarily changes a first duty ratio of each of the PWM signals to a second duty ratio higher than the first duty ratio after a predetermined time has elapsed, a period of the second duty ratio being a valve reopening period in which a power supplied to the solenoid is increased, and the solenoid valve can be caused to perform a valve opening operation again when each solenoid valve enters a closed state, the valve reopening period being periodically implemented, wherein the first duty ratio is periodically changed to the second duty ratio respectively in each of the plurality of PWM signals corresponding to the plurality of solenoids, and wherein, when a part of the plurality of solenoid valves is in the valve open state maintaining period and an issued operation command indicates that one or more additional valve opening operations for switching other solenoid valves from the closed state to the open state is to be performed at a timing that overlaps an implementation timing of the valve reopening period relating to the part of the solenoid valves, each of the one or more additional valve opening operation corresponding to the operation command is prioritized such that the valve reopening period is implemented after each of the one or more additional valve opening operations is completed.

* * * * *